US011326825B2

(12) United States Patent
Miller

(10) Patent No.: US 11,326,825 B2
(45) Date of Patent: May 10, 2022

(54) STAND-ALONE ICE AND BEVERAGE APPLIANCE

(71) Applicant: Haier US Appliance Solutions, Inc., Wilmington, DE (US)

(72) Inventor: Charles Benjamin Miller, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 0 days.

(21) Appl. No.: 16/930,523

(22) Filed: Jul. 16, 2020

(65) Prior Publication Data

US 2022/0018589 A1 Jan. 20, 2022

(51) Int. Cl.

| | |
|---|---|
| ***F25D 11/02*** | (2006.01) |
| ***F25D 23/00*** | (2006.01) |
| ***F25D 23/12*** | (2006.01) |
| ***F25C 5/20*** | (2018.01) |
| ***B67D 1/08*** | (2006.01) |
| ***F25D 29/00*** | (2006.01) |
| ***B67D 1/06*** | (2006.01) |

(52) U.S. Cl.

CPC ..... *F25D 11/022* (2013.01); *B67D 1/06* (2013.01); *B67D 1/0861* (2013.01); *F25C 5/20* (2018.01); *F25D 23/006* (2013.01); *F25D 23/126* (2013.01); *F25D 29/00* (2013.01); *F25C 2600/04* (2013.01)

(58) Field of Classification Search

CPC ..... F25D 11/02; F25D 11/022; F25D 23/126
See application file for complete search history.

(56) References Cited

U.S. PATENT DOCUMENTS 3,969,909 A * 7/1976 Barto ..... F25D 23/126 62/179
5,090,208 A * 2/1992 Aono ..... F25C 1/04 62/347
5,405,052 A * 4/1995 Sawyer, III ..... B67D 3/0009 222/64
5,987,900 A * 11/1999 Love ..... B67D 1/0857 62/348
6,967,008 B1 * 11/2005 Barnes ..... A01M 29/12 422/121

(Continued)

FOREIGN PATENT DOCUMENTS

JP 3107281 B2 11/2000

*Primary Examiner* — Nelson J Nieves
(74) *Attorney, Agent, or Firm* — Dority & Manning, P.A.

(57) ABSTRACT

A stand-alone ice and beverage dispenser is provided. Appliance includes a cabinet defining a chilled chamber, a bottom portion and a countertop. Appliance includes an ice maker assembly mounted on the countertop, a liquid dispenser assembly mounted on the countertop, and a sealed refrigeration system. Sealed refrigeration system includes a compressor, condenser, chamber evaporator, and an ice maker assembly evaporator fluidly coupled through a refrigerant conduit. The compressor is operably coupled to the refrigerant conduit for circulating a flow of refrigerant through the refrigerant conduit. Appliance also includes refrigerant valve assembly including one or more valves. Refrigerant valve assembly is configured to selectively provide refrigerant to chamber evaporator to refrigerate chilled chamber and selectively provide refrigerant to the ice maker assembly evaporator for ice production.

6 Claims, 10 Drawing Sheets

(56) References Cited

U.S. PATENT DOCUMENTS

| | | | | |
|---|---|---|---|---|
| 7,062,936 | B2 | 6/2006 | Doberstein | |
| 7,266,951 | B2 | 9/2007 | Anselmino | |
| 7,762,431 | B1 * | 7/2010 | Tuyls | F25D 31/002 222/146.6 |
| 8,336,321 | B2 | 12/2012 | Cur | |
| 8,756,950 | B2 | 6/2014 | Brunner | |
| 10,196,255 | B2 * | 2/2019 | Henriquez | B67D 1/0857 |
| 10,501,307 | B2 * | 12/2019 | Henriquez | B67D 1/0801 |
| 10,865,092 | B1 * | 12/2020 | Fitt | B67D 1/0081 |
| 2004/0188466 | A1 * | 9/2004 | Choi | F25D 23/02 222/146.6 |
| 2005/0076667 | A1 * | 4/2005 | Deem, Jr. | F25D 23/126 62/389 |
| 2005/0109056 | A1 * | 5/2005 | Rand | F25C 5/10 62/340 |
| 2006/0086132 | A1 * | 4/2006 | Maglinger | F25D 11/02 62/344 |
| 2006/0226170 | A1 * | 10/2006 | Larsen | B67D 1/0004 222/64 |
| 2009/0260371 | A1 * | 10/2009 | Kuehl | F25D 11/00 62/79 |
| 2011/0041542 | A1 * | 2/2011 | Brunner | F25C 5/22 62/344 |
| 2011/0253746 | A1 * | 10/2011 | O'Keefe, Jr. | B67D 1/0005 222/132 |
| 2013/0125571 | A1 * | 5/2013 | Goode | F25D 23/12 62/125 |
| 2014/0130890 | A1 * | 5/2014 | Chase | B67D 7/78 137/15.05 |
| 2014/0150457 | A1 * | 6/2014 | Boarman | F25C 1/04 62/3.3 |
| 2014/0150460 | A1 * | 6/2014 | Boarman | F25D 21/14 62/3.3 |
| 2017/0167783 | A1 * | 6/2017 | Jeong | B67D 1/0882 |
| 2017/0203949 | A1 * | 7/2017 | Henriquez | B67D 1/0005 |
| 2017/0292723 | A1 * | 10/2017 | Yang | F25D 3/02 |
| 2018/0010837 | A1 | 1/2018 | DuPlessis | |
| 2018/0127258 | A1 * | 5/2018 | Baysal | B67D 1/0888 |
| 2018/0187964 | A1 * | 7/2018 | Park | F25D 23/02 |
| 2019/0195543 | A1 * | 6/2019 | Shi | F25D 11/022 |
| 2019/0219323 | A1 * | 7/2019 | Dhande | F25D 29/005 |
| 2019/0316824 | A1 | 10/2019 | DuPlessis | |
| 2019/0383543 | A1 * | 12/2019 | Chandra | F25D 23/126 |
| 2020/0024120 | A1 * | 1/2020 | Park | B67D 1/0888 |
| 2020/0041191 | A1 * | 2/2020 | You | F25C 5/22 |
| 2020/0121119 | A1 * | 4/2020 | Zuo | A47J 31/605 |
| 2020/0124333 | A1 * | 4/2020 | Aranda | F15D 1/06 |
| 2020/0129898 | A1 * | 4/2020 | Simpson | B01D 35/306 |
| 2020/0141095 | A1 * | 5/2020 | Seeley | F25D 17/06 |
| 2020/0182525 | A1 * | 6/2020 | Scalf | F25C 5/22 |
| 2020/0182534 | A1 * | 6/2020 | Scalf | G01F 23/24 |
| 2020/0182535 | A1 * | 6/2020 | Scalf | B67D 1/00 |
| 2020/0208904 | A1 * | 7/2020 | Choy | G01F 15/003 |
| 2021/0010746 | A1 * | 1/2021 | Choi | F25D 25/005 |
| 2021/0018237 | A1 * | 1/2021 | Junge | F25C 1/10 |
| 2021/0048237 | A1 * | 2/2021 | McCollough | F25C 5/22 |
| 2021/0076862 | A1 * | 3/2021 | Gardner | F25D 11/02 |

* cited by examiner

STAND-ALONE ICE AND BEVERAGE APPLIANCE

FIELD

The present disclosure relates generally to appliances and, more particularly, to a stand-alone appliance that dispenses ice and beverages.

BACKGROUND

Certain consumer appliances, such as refrigerators, include a dispenser for providing liquids and ice. For example, ice can be provided from the refrigerator's ice maker. Additionally, water may be routed through the refrigerator compartments for cooling prior to dispensing. A user can activate the dispenser to direct a flow of ice or water into a cup positioned within the dispenser.

These existing approaches present certain challenges. For instance, the incorporation of ice makers and beverage dispensers into other appliances, such as refrigerators, can have drawbacks such as limitations on the amount of ice that can be produced. Additionally, the incorporation of ice makers and beverage dispensers into refrigerators can add complexity. As such, reliability or functionality of the refrigeration system of the refrigerator can be negatively impacted. For example, the effectiveness of the appliance can be reduced or the ability of the refrigeration system to form the ice can be unreliable. Furthermore, these dispensers can occupy significant amounts of storage space within a refrigerator appliance and thus, reduce storage capacity of the chilled chambers of the refrigerator.

Accordingly, stand-alone ice makers have been developed. These ice makers are separate from refrigerator appliances and provide independent ice supplies. Generally, ice is provided into an interior volume. However, many stand-alone ice makers do not include an interior volume that is visible without opening the ice maker. Condensation and/or insulation may create difficulties in determining how much ice is contemporaneously available within the interior volume. Moreover, removing ice from the interior volume of many existing systems may be difficult. The area defining the interior volume may be provided as a removable bucket. Such systems may become increasingly heavy and/or difficult to remove if, for instance, a large amount of ice is held therein. If any ice within the interior volume has melted, it may be further difficult to remove the liquefied ice or water. Additionally or alternatively, difficulties may arise when trying to add water to the system for producing ice (e.g., without inadvertently spilling water outside the ice maker or within an undesired interior portion of the ice maker). Furthermore, these stand-alone ice makers can consume counter-space. For these reasons, existing stand-alone ice makers can be difficult or expensive to retrofit into existing locations that are convenient or desirable for consumers, such as a location that is near beverage dispensers, beverage storage or other existing appliances in a consumer space. Similarly, due to the positioning of refrigeration components existing stand-alone ice makers can produce excess noise and may not be suitable for installation into locations that are convenient or desirable for consumers, such as a location that is near beverage dispensers, beverage storage or other existing appliances in a consumer living space.

Accordingly, a stand-alone ice maker and beverage dispenser appliance with features that address one or more of the challenges noted above would be useful and welcomed.

BRIEF DESCRIPTION

Aspects and advantages of embodiments of the present disclosure will be set forth in part in the following description, or may be learned from the description, or may be learned through practice of the embodiments.

One example aspect of the present disclosure is directed to a stand-alone ice and beverage dispenser appliance including a cabinet defining a chilled chamber. Ice and beverage dispenser appliance cabinet can also define a bottom portion and a countertop. Appliance can include a chilling assembly, including a reservoir, located within chilled chamber. Appliance can also include an ice maker assembly mounted on the countertop and a liquid dispenser assembly mounted on the countertop. The appliance can have a sealed refrigeration system including a compressor, a condenser, a chamber evaporator, and an ice maker assembly evaporator fluidly coupled through a refrigerant conduit. The compressor is operably coupled to the refrigerant conduit for circulating a flow of refrigerant through the refrigerant conduit. Sealed refrigeration system also includes a refrigerant valve assembly, which can include one or more valves. The valve assembly is configured to selectively provide the flow of refrigerant to the chamber evaporator to refrigerate the chilled chamber and selectively provide the flow of refrigerant to the ice maker assembly evaporator for ice production.

Another exemplary embodiment of the present disclosure is directed to a consumer appliance with a cabinet including a bottom portion and a countertop. The cabinet defines a chilled beverage chamber and a chilled lower chamber. The appliance includes a first door being operably coupled to the cabinet to provide selective access to the chilled beverage chamber and also includes a second door being operably coupled to the cabinet to provide selective access to the chilled lower chamber. Appliance can have an ice maker assembly mounted on the countertop and a water dispenser assembly mounted on the countertop. Appliance also includes a sealed refrigeration system with a compressor, a condenser, a chamber evaporator, and an ice maker assembly evaporator fluidly coupled through a refrigerant conduit. The compressor is operably coupled to the refrigerant conduit for circulating a flow of refrigerant through the refrigerant conduit, a first refrigerant valve and a second refrigerant valve. The first refrigerant valve and second refrigerant valve are configured to selectively provide refrigerant to chamber evaporator to refrigerate chilled chamber and selectively provide refrigerant to the ice maker assembly evaporator for ice production.

Yet another exemplary embodiment of the present disclosure is directed to a method for controlling an appliance. The appliance includes a cabinet defining a chilled chamber, an ice maker assembly mounted on the cabinet and a sealed refrigeration system. The sealed refrigeration system includes a compressor, a condenser, a chamber evaporator, and an ice maker assembly evaporator fluidly coupled through a refrigerant conduit. Sealed refrigeration system also includes a first refrigerant valve and a second refrigerant valve. The method includes determining, by one or more controllers, the operational status of the ice maker assembly based on an amount of ice within a container. The method also includes generating, by one or more controllers, a control signal based on the operational state of the ice maker assembly and operating, by one or more controllers, the refrigerant valve and the sealed refrigeration system based, at least in part, on the control signal.

Variations and modifications can be made to these example aspects of the present disclosure. These and other features, aspects and advantages of various embodiments will become better understood with reference to the following description and appended claims. The accompanying drawings, which are incorporated in and constitute a part of this specification, illustrate embodiments of the present disclosure and, together with the description, serve to explain the related principles.

BRIEF DESCRIPTION OF THE DRAWINGS

A full and enabling disclosure of the present subject matter, including the best mode thereof, directed to one of ordinary skill in the art, is set forth in the specification, which makes reference to the appended figures, in which.

Figure 1:
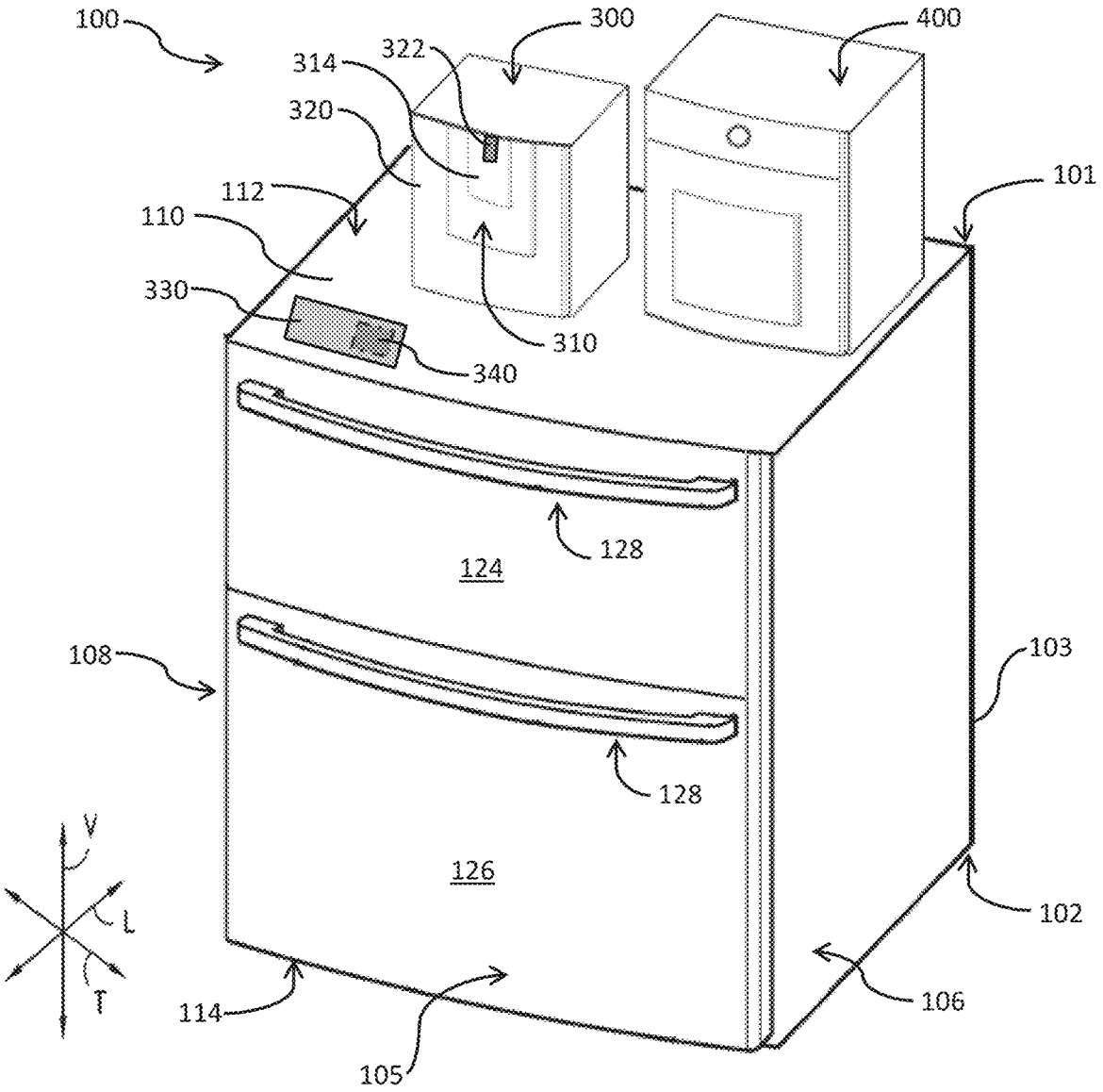
FIG. 1 depicts a front perspective view of a stand-alone ice and beverage appliance according to exemplary embodiments of the present disclosure.

Repeat use of reference characters in the present specification and drawings is intended to represent the same or analogous features or elements of the present disclosure.

DETAILED DESCRIPTION

Reference now will be made in detail to embodiments of the disclosure, one or more examples of which are illustrated in the drawings. Each example is provided by way of explanation of the disclosure, not limitation of the disclosure. In fact, it will be apparent to those skilled in the art that various modifications and variations can be made in the present disclosure without departing from the scope or spirit of the disclosure. For instance, features illustrated or described as part of one embodiment can be used with another embodiment to yield a still further embodiment. Thus, it is intended that the present disclosure covers such modifications and variations as come within the scope of the appended claims and their equivalents.

As used herein, terms of approximation, such as "approximately," "substantially," or "about," refer to being within a ten percent margin of error.

Referring now to the figures, example aspects of the present disclosure will be discussed in greater detail.

FIG. 1 provides a front perspective view of a stand-alone ice and beverage appliance 100 according to exemplary embodiments of the present disclosure. Ice and beverage appliance 100 defines a vertical direction V, a lateral direction L, and a transverse direction T. The vertical, lateral, and transverse directions V, L, and T are mutually perpendicular and form an orthogonal direction system.

Figure 2:
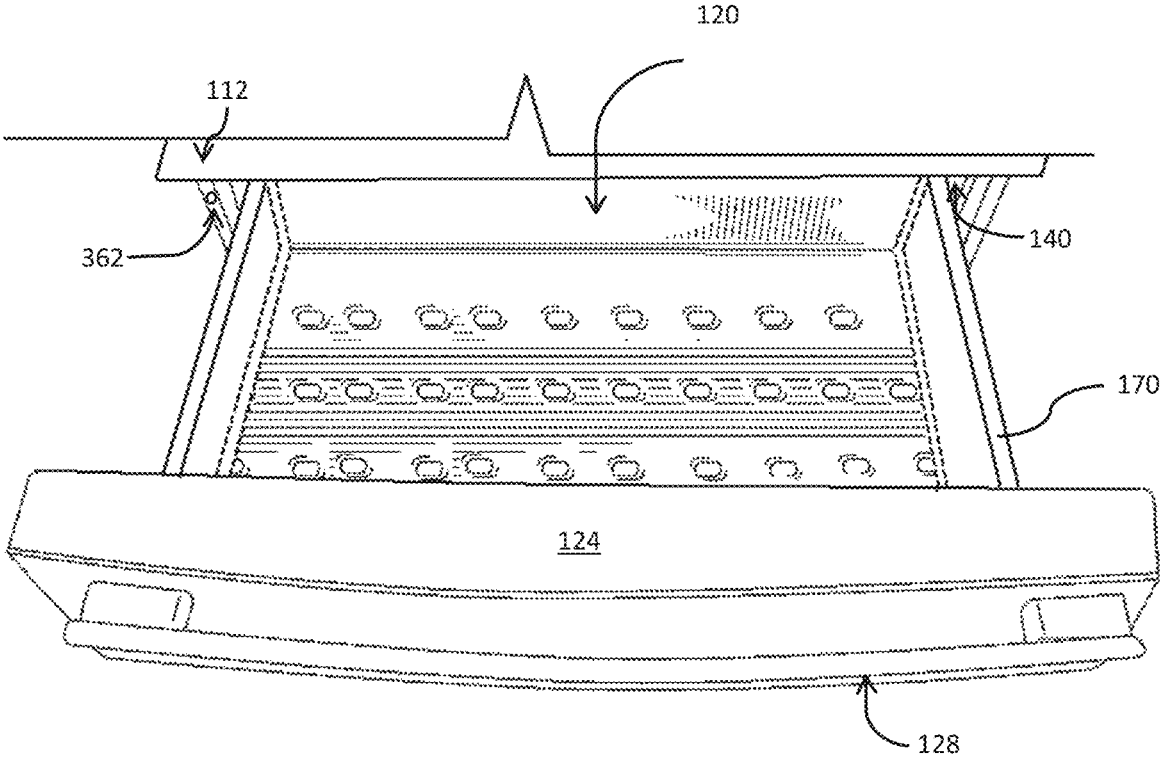
FIG. 2 depicts a partial perspective view of a stand-alone ice and beverage appliance of FIG. 1 shown with the beverage chamber in an open position.
Figure 3:
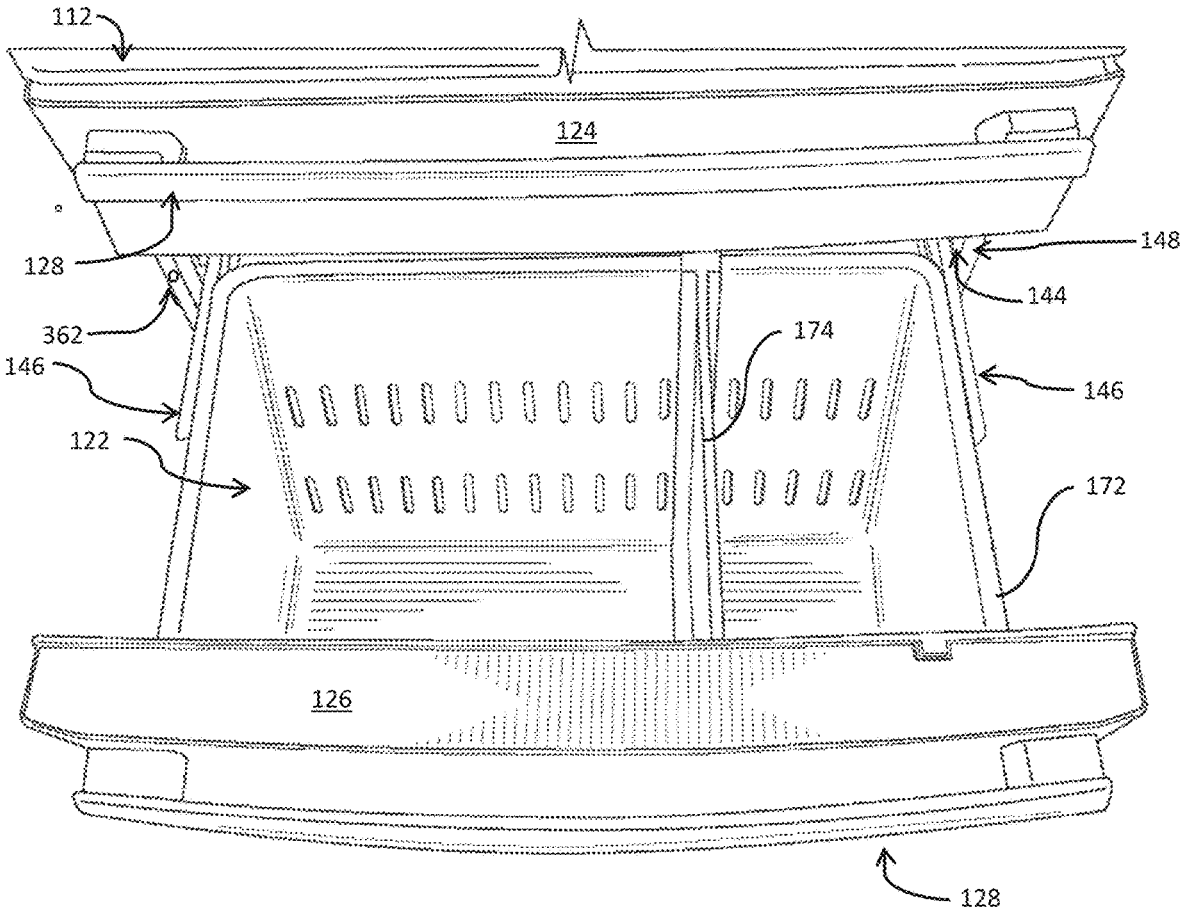
FIG. 3 depicts a partial perspective view of a stand-alone ice and beverage appliance of FIG. 1 shown with the beverage chamber in a closed position and the lower chamber in an open position.

Referring now generally to FIGS. 1 through 3. FIG. 2 depicts a partial perspective view of the stand-alone ice and beverage appliance 100 of FIG. 1 shown with the beverage chamber 120 of the appliance in an open position. FIG. 3 depicts another partial perspective view of the stand-alone ice and beverage appliance 100 of FIG. 1 shown with the beverage chamber 120 of the appliance in a closed position and the lower chamber 122 in an open position.

Ice and beverage appliance 100 can include a cabinet or housing 110 that extends between a countertop portion 112 and a bottom portion 114 along the vertical direction V. In some applications countertop portion 112 of ice and beverage appliance 100 can be substantially parallel to an adjacent surface, e.g., the height of the countertop in a user's kitchen or home. Similarly, the dimension of housing 110 in a lateral direction L can be substantially equivalent to the dimensions of an adjacent structure, e.g., substantially equivalent to the depth of a user's cabinets, cabinets or existing appliances. Housing 110 defines one or more chambers (shown in FIGS. 2 and 3) for receipt of beverages or other items for storage. As discussed herein, the one or more chambers can be selectively chilled. In particular, housing 110 defines beverage chamber 120 (shown in FIGS. 2 and 4 through 6) positioned at or adjacent to countertop 112 of housing 110 and a lower chamber 122 (shown in FIGS. 2 and 4 through 6) arranged at or adjacent to bottom portion 114 of housing 110. It is recognized, however, that the benefits of the present disclosure apply to other types and styles of appliances or chamber configurations. Consequently, the description set forth herein is for illustrative purposes only and is not intended to be limiting in any aspect to any particular refrigerator chamber configuration.

Housing 110 also extends between a right side portion 106 and a left side portion 108, e.g., along the transverse direction T, forming a front portion 105. Housing 110 defines an opening 140 (shown in FIGS. 2 and 4 through 6) for accessing the beverage chamber 120 and an opening 144 for accessing lower chamber 122 (shown in FIGS. 3 and 4 through 6) at or adjacent front portion 105 of housing 110. Housing 110 also includes a back wall 103 extending between a bottom portion 102 and a top portion 101, e.g., along the vertical direction V. Housing 110 also includes a left side portion 108 and a right side portion 106, both of which extend between front portion 105 and back wall 103, e.g., along the lateral direction L.

Beverage chamber door 124 can be coupled to a beverage drawer 170 (shown in FIG. 2) which can be slidably mounted within beverage chamber 120 (shown in FIG. 2), e.g., at front portion 105 of housing 110, for selectively accessing beverage chamber 120. In alternate embodiments, beverage chamber door 124 can be rotatably mounted or hinged 510 to left side portion 108, or alternatively right side portion 106, of housing 110, e.g., adjected to front portion 105 of housing 110, for selectively accessing beverage chamber 120 (shown in FIGS. 4 and 5).

Figure 4:
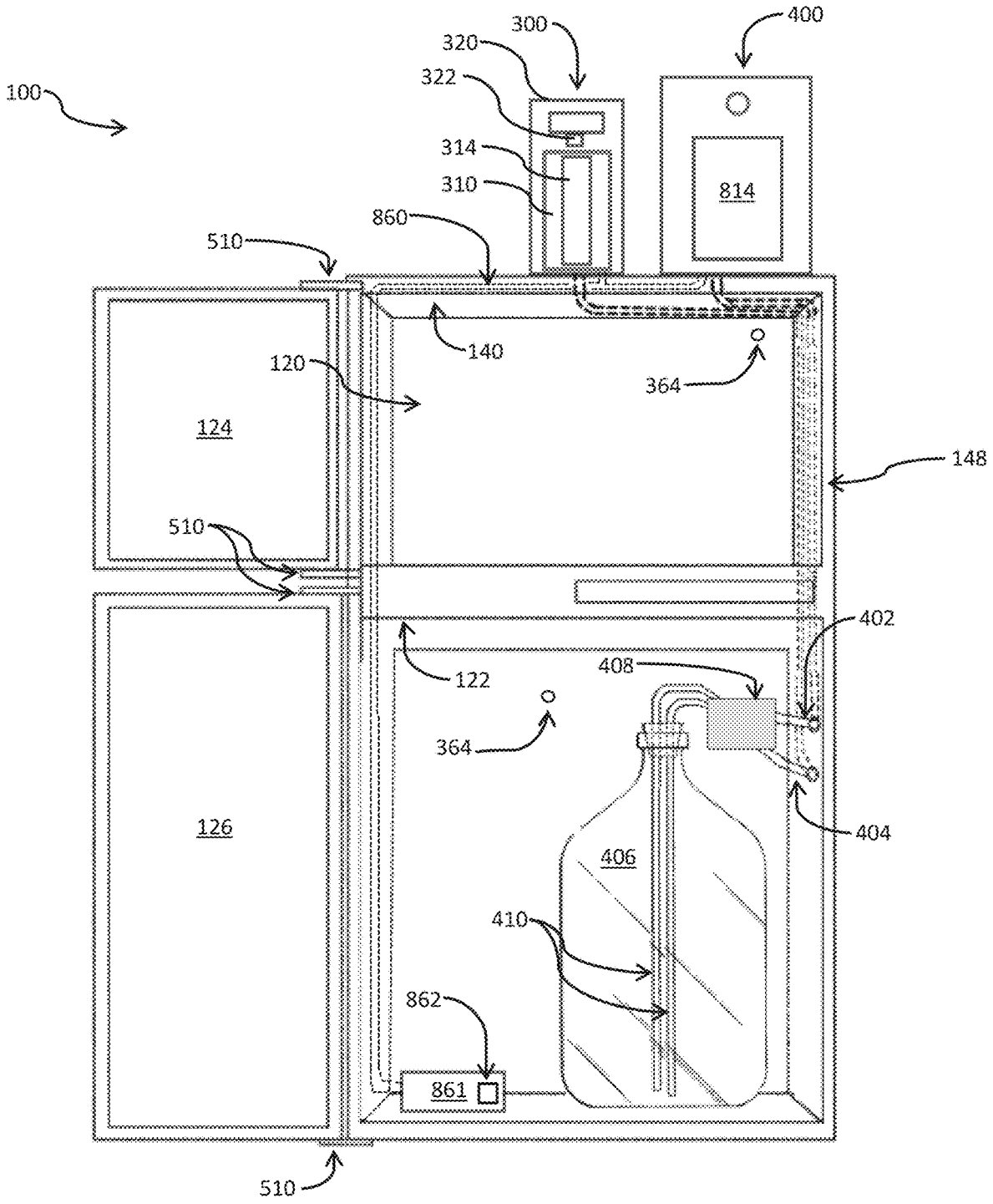
FIG. 4 depicts a front view of another embodiment of a stand-alone ice and beverage appliance according to exemplary embodiments of the present disclosure shown with the beverage chamber in an open position and the lower chamber in an open position.
Figure 5:
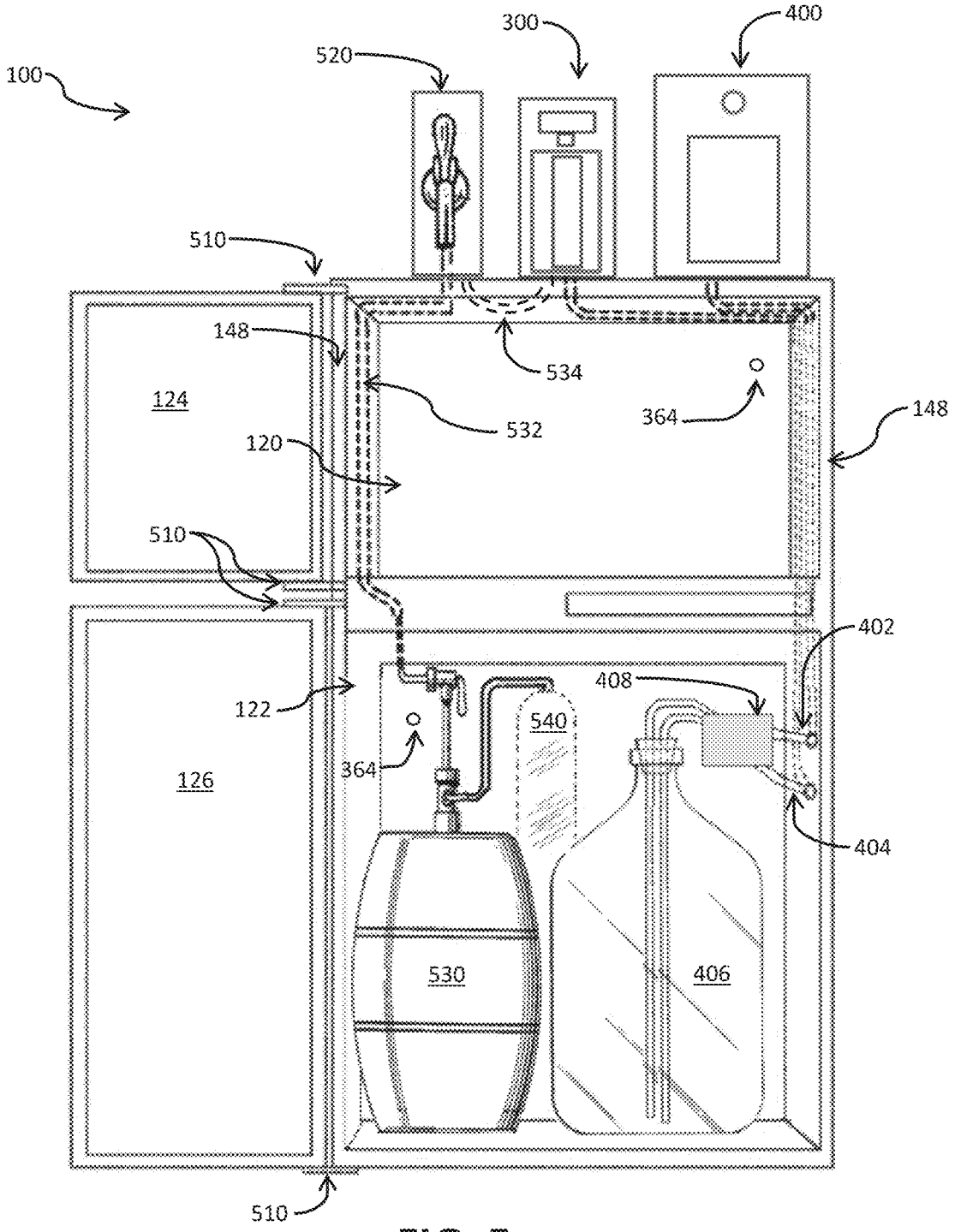
FIG. 5 depicts an additional front view of the stand-alone ice and beverage appliance of FIG. 4, with additional beverage dispensing features depicted.

A lower chamber door 126 is arranged below beverage chamber door 124, in a vertical direction V, for selectively accessing lower chamber 122 (shown in FIGS. 3 and 4 through 6). Lower chamber door 126 can be coupled to a lower chamber drawer 172 (shown in FIG. 3) slidably mounted within lower chamber (for example by brackets 146 as shown in FIG. 3). Lower chamber door 126 can be coupled to a lower chamber drawer 172 (shown in FIG. 3) which can be slidably mounted within lower chamber 122 (not shown), e.g., at front portion 105 of housing 110, for selectively accessing lower chamber 122. In alternate embodiments, lower chamber door 126 can be rotatably mounted or hinged 510 to left side portion 108, or alternatively right side portion 106, of housing 110, e.g., adjacent to front portion 105 of housing 110, for selectively accessing lower chamber 122 (as shown in FIGS. 4 and 5).

Beverage chamber door 124 and lower chamber door 126 are shown in a closed position in FIG. 1. Conversely, beverage chamber door 124 is shown in an open position in FIG. 2 and lower chamber door 126 is shown in an open position in FIG. 3. In the open position, beverage chamber door 124 permits access to beverage chamber 120 through opening 140. Conversely, beverage chamber door 124 obstructs or limits access to beverage chamber 120 through opening 140 in the closed position in FIG. 1. Lower chamber door 126 operates similarly by allowing access to lower chamber through opening 144. Handles 128 can assist with operating beverage chamber door 124 and lower chamber door 126 between the open and closed positions.

Ice and beverage appliance 100 can include an ice maker assembly 400 and a water dispenser assembly 300. Ice maker assembly 400 and water dispensing assembly 300 can be positioned on or mounted to countertop 112 of housing 110, using any suitable method, e.g., mechanical fasteners (i.e., screws or bolts).

Water dispenser assembly 300 can dispense various fluids, such as liquid water, to a dispenser recess 310 defined within a housing 320. Water dispensing assembly 300 includes a liquid outlet 322 positioned on an exterior portion of water dispenser assembly 300, for example, within dispenser recess 310. Liquid outlet 322 includes an opening for liquid water or another beverage to be dispensed.

To access liquid water or another beverage, water dispensing assembly 300 may, for example, include a paddle 314 mounted below a liquid outlet 322. To initiate certain exemplary operations of water dispenser assembly 300, a user can place or press a container (not shown), such as a cup or bowl, against paddle 314 to initiate a flow of liquid, e.g. water, into the container within dispenser recess 310.

In some embodiments, a control panel or user interface panel 330 may be provided for controlling the mode of operation of ice and beverage appliance 100, and the components thereof, including water dispenser assembly 300 (e.g., for enabling the operation of or turning on the water dispenser assembly 300) and ice maker assembly 400 (e.g., for enabling the operation of or turning on ice maker assembly 400). User interface panel 330 can include a water dispensing button (not labeled) and other buttons (not labeled), e.g., temperature control buttons for setting or adjusting the temperature of the beverage chamber 120 or lower chamber 122. Additionally or alternatively, user interface panel 330 can include one or more inputs (e.g., buttons, switches, touch screen panels, etc.) for selecting various operations, such a preset dispensing operation (e.g., for a heated fluid or liquid). User interface panel 330 may also include a display component, such as a digital or analog display device designed to provide operational feedback to the user.

Liquid outlet 322 and paddle 314 may be an external part of water dispenser assembly 300 and are positioned at or adjacent to dispenser recess 310. Dispenser recess 310 can be a concave portion defined in an outside surface of housing 310. Water dispenser assembly 300 is positioned at a predetermined elevation convenient for a user to access liquid water (e.g., enabling the user to access water without the need to bend-over and without the need to access beverage chamber 120 or lower chamber 122). In optional embodiments, water dispenser assembly 300 is positioned at a level that approximates the chest level of a user.

Operation of the ice and beverage appliance 100 can be regulated by a controller 340 that is operatively coupled to user interface panel 330 and various sensors and components of ice and beverage appliance 100 as discussed below. User interface panel 330 provides selections for user manipulation of the operation of ice and beverage appliance 100 such as, for example, for enabling the operation of or turning on the water dispenser assembly 300, for enabling the operation of or turning on the ice maker assembly 400 or for setting or adjusting the temperature of the beverage chamber 120 or lower chamber 122. In response to user manipulation of the user interface panel 330 or signals from sensors, controller 340 may operate various components of the ice and beverage appliance 100 as discussed herein.

Controller 340 may include a memory and one or more microprocessors, CPUs or the like, such as general or special purpose microprocessors operable to execute programming instructions or micro-control code associated with operation of ice and beverage appliance 100. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 340 may be constructed without using a microprocessor (e.g., using a combination of discrete analog or digital logic circuitry; such as switches, amplifiers, integrators, comparators, flip-flops, AND gates, and the like) to perform control functionality instead of relying upon software.

Controller 340 may be positioned in a variety of locations throughout ice and beverage appliance 100. In the illustrated embodiment in FIG. 1, controller 340 is located within the user interface panel 330. In other embodiments, the controller 340 may be positioned at any suitable location within ice and beverage appliance 100, such as for example within beverage chamber 120, beverage chamber door 124, etc. Input/output ("I/O") signals may be routed between controller 340 and various operational components of ice and beverage appliance 100. For example, user interface panel 330 may be in communication with controller 340 via one or more signal lines or shared communication busses.

As illustrated, controller 340 may be in communication with the various components of sealed system 620, water dispenser assembly 300 and ice maker assembly 400 and may control operation of the various components thereof. For example, the various valves (e.g., refrigerant valves 600, 602 and 603, shown in FIG. 6), switches, pumps (e.g., water transfer pump 408 shown in FIGS. 4-6) etc. may be actuatable based on commands from the controller 340. As discussed, interface panel 360 may additionally be in communication with the controller 340. Thus, the various operations may occur based on user input or automatically through controller 340 instruction based on certain signals from sensors of appliance 100.

Controller 340 can receive signals from inputs such as, for example, one or more door switch sensors 362 (shown in FIGS. 2 and 3) for determining when a door such as beverage chamber door 124 is open or lower chamber door 126 is open, and one or more temperature sensors 364 (shown in FIGS. 4-6) for determining the temperature in the beverage chamber 120 and lower chamber 122. Controller 340 can also receive signals from other inputs associated with ice and beverage appliance 100 including ambient temperature, ambient humidity, or the like. Moreover, controller 340 is operatively coupled to the sealed system 620 (shown in FIG. 5), whereby, certain functions are performed in response to signals received from these inputs.

In the exemplary embodiment, controller 340 operates sealed system 620 based on one or more characteristics of one or more temperature sensors 364. Temperature sensors 364 can be any known electronic temperature sensing devices, such as the one or more thermistors. Specifically, controller 340 can receive data indicative of the one or more characteristics of the temperature sensors 364 and process the data to determine the temperature of the beverage chamber 120 and lower chamber 122.

Controller 340 can compare the temperature of the beverage chamber 120 and lower chamber 122 to one or more predetermined temperature thresholds, which can be provided by a user through user interface 330. For example, the predetermined temperature thresholds can be stored in a memory of controller 340 and can be a temperature or range of temperatures that are determined, by a party other than the end user of the refrigerator such as by the manufacturer, as the intended operating temperature, state or condition of the beverage chamber 120 and lower chamber 122. For example a predetermined threshold associated with the beverage chamber 120 and lower chamber can be a temperature at or near thirty-seven degrees (37°) Fahrenheit or any other temperature selected by a user. Advantageously, controller 340 can initiate sealed system 620 and operate components thereof (including the various valves, e.g., refrigerant valves 600, 602 and 603, shown in FIG. 6) which results in air flow and cooling of the beverage chamber 120 and/or lower chamber 122. Controller 340 can receive a signal from temperature sensors 364 while sealed system 620 is operating. The one or more temperature sensors 364 function to determine the temperature of beverage chamber 120 and lower chamber 122. Typically, controller 340 can regularly cycle between readings for beverage chamber 120 and lower chamber 122.

Moreover, controller 340 can operate sealed system 620 based on inputs from the one or more door switch sensors 362. Specifically, when door switch sensor 362 determines that a door, such as beverage chamber door 124 or lower chamber door 126, is in the open position, controller 340 changes the mode of operation of sealed system 620. For example, sealed system 620 can cease operation in response to beverage chamber door 124 or lower chamber door 126 being in the open position. Alternatively, sealed system 620 can operate in a power save mode when beverage chamber door 124 or lower chamber door 126 is open.

It should be appreciated that alternate beverage service devices could be utilized with appliance 100 in place of or in conjunction with water dispenser assembly 300. For example, ice and beverage appliance 100 could include a single service coffee maker in addition to or in place of water dispenser assembly 300, such as brew module 900 shown in FIG. 9.

As shown in FIGS. 2 and 3, various storage components can be mounted within beverage chamber 120 and lower chamber 122 to facilitate storage of beverages or other items therein as will be understood by those skilled in the art. In particular, the storage components include drawers (170 and 172), bins (not shown), dividers 174 (shown in FIG. 3) and shelves (not shown) can be mounted within or to lower chamber 122 and beverage chamber 120. For example, drawers (170 and 172), are configured for receipt of beverages or liquids for dispensing or for use in the production of ice and may assist with organizing and storing such items. As an example, drawer 170 can receive canned or bottled beverage items (e.g., soda, water, beer, wine, etc.). In some embodiments, beverage chamber 120 and lower chamber 122 will not include additional storage components (as shown in FIGS. 4 and 5) and storage of items is accomplished by placing the items within beverage chamber 120 and lower chamber 122.

Figure 6:
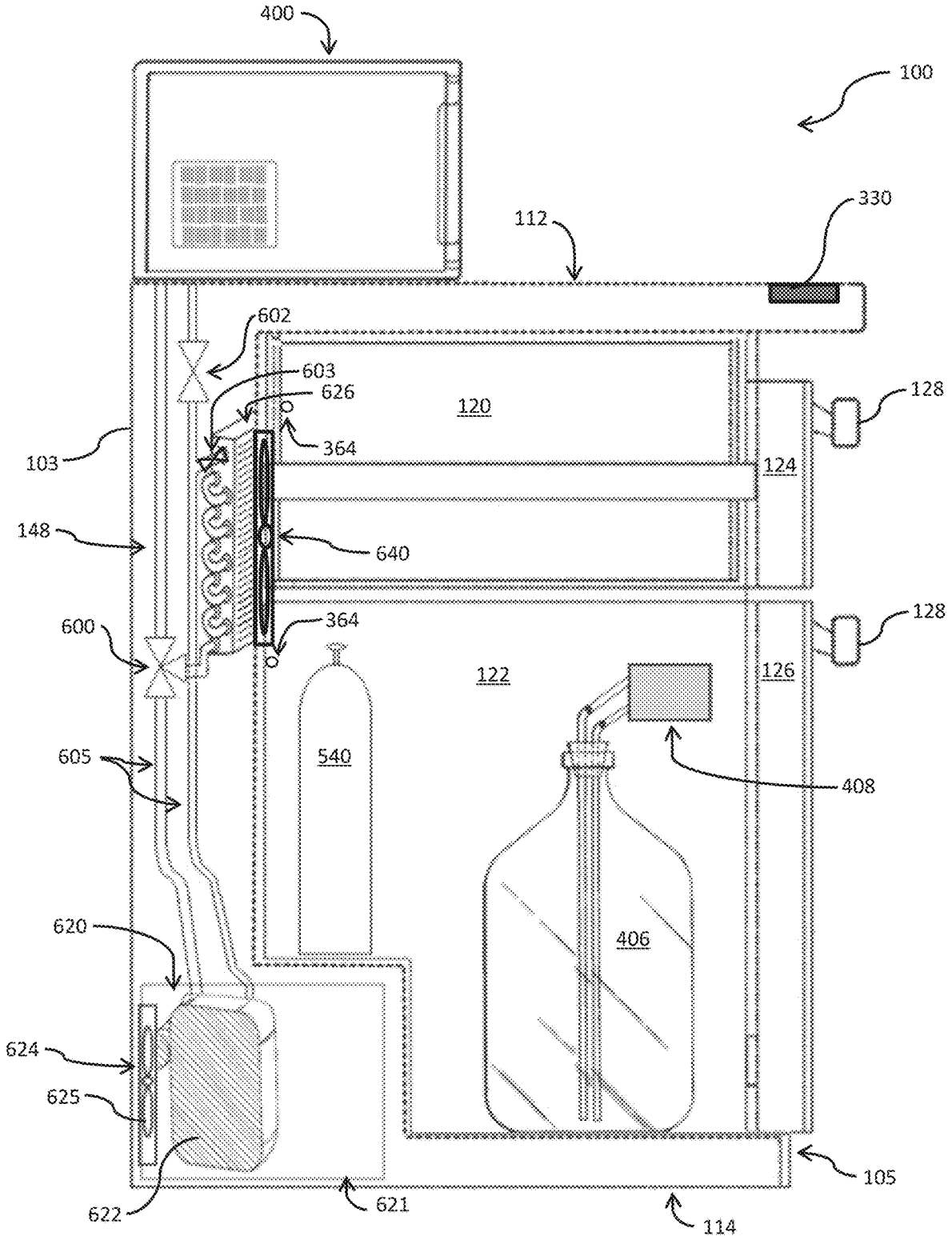
FIG. 6 depicts a side sectional view of the stand-alone ice and beverage appliance of FIGS. 4 and 5, showing certain refrigeration system components of the exemplary appliance.

Although the illustrated embodiment shows drawers (170 and 172) positioned along the transverse direction T, it should be appreciated that aspects of the present disclosure may be applied to other storage device or assembly styles and configurations. For example, lower chamber 122 may include a shelf (not shown) which could extend from the lower chamber 122 in a lateral direction L, when lower chamber door 126 is affixed to housing 110 with hinges 510, as depicted in FIGS. 4 through 6, with such shelf extending from the right-side portion 106 to the left side portion 108 of ice and beverage appliance 100 along a transverse direction T. Lower chamber 122 and beverage chamber 120 are situated within housing 110 such that an insulating layer 148 is formed between housing and lower chamber 122 and beverage chamber 120.

Referring now generally to FIGS. 4 and 5. FIG. 4 depicts a front view of another example embodiment of a stand-alone ice and beverage appliance 100 according to exemplary embodiments of the present disclosure, shown with the beverage chamber door 124 in an open position and the lower chamber door 126 in an open position. Ice and beverage appliance 100 can include one or more supply lines conduits or hoses (402 and 404) in fluid connection with water source 406. Supply line 402 can be in fluid connection between water source 406 and ice maker assembly 400 to enable the transfer of water from water source 406 to ice maker assembly 400 to facilitate production of ice. Similarly, supply line 404 can be in fluid connection between water source 406 and water dispenser assembly 300 to enable the transfer of water from water source 406 to water dispenser assembly 300 to facilitate providing liquid water to a user through liquid outlet 322.

Water source 406 can be a domestic water supply, e.g., water piping or a water supply within an existing structure. Alternatively, water source 406 can be a portable water storage device, e.g., a bottle of drinking water as shown in FIGS. 4 through 6. In some embodiments where the water source 406 is a domestic water supply, filters or other water purification devices can be mounted within lower chamber 122. Water source 406 can be a bottle of drinking water, (e.g., such a five-gallon bottle of drinking water which is often used in existing water coolers). Ice and beverage appliance 100 can also include pick-up lines 410 which are submerged in the water contained in water source 406. Ice and beverage appliance 100 can also include a transfer pump 408 to transfer water from water supply 406 to water dispenser assembly 300 and ice maker assembly 400 when the water contained within water supply 406 is not pressurized. Operation of transfer pump 408 can be controlled by controller 340. For example, in response to a user pressing or engaging paddle 314 of water dispenser assembly 300, controller 340 can send a signal to transfer pump 408 to turn on and thereby pump water from water source 406 through pickup lines 410, and through supply line 404 to liquid outlet 322. Similarly, when a user stops pressing or engaging paddle 314 on water dispensing assembly, controller 340 can send a signal to transfer pump 408 to turn off and thereby cease pumping water from water source 406 to liquid outlet 322 through supply line 404.

Furthermore, controller 340 can send a signal to transfer pump 408 to turn on and pump water from water source 406 to ice maker assembly 400 through supply line 402, when controller receives a signal from one or more sensors (such as an ultrasonic sensor (not shown) in ice maker assembly 400 which can detect the amount of ice present in ice container 814 of ice maker assembly 400) of ice maker assembly 400 that water is required by ice maker assembly 400 to facilitate the production of ice because ice container 814 is not full of ice. Similarly, controller 340 can send a signal to transfer pump 408 to turn off and cease pumping water from water source 406 to ice maker assembly 400 through supply line 402, when controller receives a signal from one or more sensors (such as an ultrasonic sensor) of ice maker assembly 400 that a sufficient amount of water is present at ice maker assembly 400 to facilitate the production of ice or the one or more sensors indicate that ice container 814 is full of ice.

In exemplary embodiments, drain 860 may be in fluid connection with a domestic drain/sewer line (not shown) or, alternatively, drain 860 can be in fluid connection with drainage receptacle 861, e.g., a pan, could be provided in ice and beverage appliance 100 (such as in lower chamber 122) to receive water from drain 860. Drain 860 may be formed as a hollow conduit, of a suitable resilient material, e.g., rubber (natural or synthetic), plastic, etc.

Referring now generally to FIGS. 5 through 8. FIG. 5 depicts an additional front view of the stand-alone ice and beverage appliance 100 of FIG. 4, with additional beverage dispensing features described below. Ice and beverage appliance 100 can include features associated with dispensing beverages other than water. As depicted in FIG. 5, ice and beverage appliance 100 can include a tap 520 for dispensing carbonated beverages from container 530. For example, carbonated beverage 530 can be beer or soda or ingredients thereof (i.e., soda syrup). Ice and beverage appliance 100 can also include a tank 540 containing pressurized gas, such as $CO_2$, to pressurize container 530 and facilitate the transfer of liquid from container 530 to tap 520 through supply line 532. Alternatively, tank 530 could be utilized to create and dispense carbonated water through tap 520. When container 530 includes liquid, which requires the addition of water prior to consumption, e.g., syrup for soda, transfer pipe 534 can facilitate the transfer of water from water dispenser assembly 300 to tap 520, where water from water source 406 can be mixed with the liquid in container 530 when dispensed from tap 520. As shown in FIGS. 4 and 5 supply lines (402, 404 and 532) and transfer pipe 534 can be situated, at least in part, within lower chamber and situated, at least in part, within insulating layer 148 of ice and beverage appliance 100.

FIG. 6 depicts a side sectional view of the stand-alone ice and beverage appliance 100 of FIGS. 4 and 5, showing certain components of a sealed refrigeration system 620 located within the housing 110.

As discussed herein, water within the ice maker assembly 400 may at least partially freeze due to heat exchange, such as with a refrigeration system. In exemplary embodiments, ice and beverage appliance 100 may include a sealed refrigeration system 620. The sealed refrigeration system 620 may be in thermal communication with the ice maker assembly 400 to remove heat from the casing 752 and interior volume 756 thereof (shown in FIG. 8), thus facilitating freezing of water therein to form ice. Sealed refrigeration system 620 may, for example, include a compressor 622, a condenser 624 and associated fan 625, a throttling or expansion device 686 (shown in FIG. 7), an ice maker evaporator 628 (shown in FIG. 8) and a chamber evaporator 626.

Compressor 622, condenser 624, expansion device 686, ice maker evaporator 628 (shown in FIG. 8) and a chamber evaporator 626 are fluidly coupled through refrigerant conduit 605, and refrigerant conduit facilitates circulation of a flow of refrigerant through the refrigerant conduit to the components of sealed refrigeration system 620.

Ice maker evaporator 628 may, for example, be in thermal communication with the ice maker casing 752 (shown in FIG. 8) in order to remove heat from the interior volume 756 and water therein during operation of sealed system 620. For example, ice maker evaporator 628 may at least partially surround the casing 752. In particular, ice maker evaporator 628 may be a conduit coiled around and in contact with casing 752, such as the sidewall(s) 754 thereof (shown in FIG. 8).

Similarly, air which is forced, pushed or blown, by e.g., fan 640, into beverage chamber 120 and lower chamber 122 may at least partially cooled or chilled due to heat exchange, such as with a refrigeration system 620, and more specifically chamber evaporator 626. In exemplary embodiments, ice and beverage appliance 100 may include a sealed refrigeration system 620. The sealed refrigeration system 620 may be in thermal communication with air which is force, pushed or blown, by e.g., fan 640, into beverage chamber 120 and lower chamber 122 to remove heat from the air, thus facilitating chilling or cooling of beverage chamber 120 and/or lower chamber 122. Sealed refrigeration system 620 may, for example, include a compressor 622, a condenser 624 and a chamber evaporator 626 and an associated fan 640. Chamber evaporator 626 may, for example, be in thermal communication with the air which is forced, by e.g., fan 640, into beverage chamber 120 and lower chamber 122, in order to remove heat from the air and thereby chill or cool beverage chamber 120 and/or lower chamber 122 during operation of sealed refrigeration system 620. For example, chamber evaporator 626 may be mounted adjacent to beverage chamber 120 and lower chamber 122 and proximate to insulating layer 148. In particular, chamber evaporator 626 may be a conduit configured such that air may be forced, blown or drawn across said conduit by fan 640.

It should additionally be noted that, in exemplary embodiments, controller 340 may be in operative communication with the sealed refrigeration system 620, such as with the compressor 622 thereof, and may activate the sealed system 620 as desired or required for ice making purposes or to chill, refrigerated or regulate the temperature of beverage chamber 120 and/or lower chamber 122.

The compressor 622, condenser 624 and fan 625 of sealed refrigeration system 620 is mounted adjacent to the back wall 103 of housing and adjacent to bottom portion 114 of housing 110. The compressor 622, condenser 624 and fan 625 can also be mounted within an insulated compartment 621 to decrease transmission of sound and noise associated with the operation of these components where it may be heard or perceived by a user. Those of ordinary skill will appreciate that compressor 622, condenser 624 and fan 625 can be mounted in other locations away from the front 105 of housing and countertop 112 of appliance to reduce transmission of sound and noise.

Sealed refrigeration system 620 can further include a first refrigerant valve 600 and a second refrigerant valve 602 to control the flow of refrigerant from compressor 622 and condenser 624 to ice maker evaporator 628 and chamber evaporator 626. In exemplary embodiments, controller 340 is in operative communication with first refrigerant valve 600, second refrigerant valve 602 and third refrigerant valve 603. Such operative communication may be via a wired or wireless connection, and may facilitate the transmittal, e.g., of control signals, and/or receipt of signals by the controller 340 and first refrigerant valve 600, second refrigerant valve 602 and third refrigerant valve 603. Controller 340 may be configured to activate the sealed refrigeration system 620 and open first refrigerant valve 600, open second refrigerant valve 602 and open third refrigerant valve 603 to actively flow refrigerant to ice maker evaporator 628 (to facilitate production of ice by ice maker assembly 400) and chamber evaporator 626 (to facilitate cooling of beverage chamber 120 and/or lower chamber 122). Controller 340 may also be configured to activate sealed refrigeration system 620 and selectively open and close first refrigerant valve 600 and selectively open second refrigerant valve 602 and selectively close third refrigerant valve 603 such to actively flow refrigerant to ice maker evaporator 628 (to facilitate production of ice by ice maker assembly 400) and to prevent refrigerant from flowing to chamber evaporator 626. In this way controller 340 can cause ice maker assembly 400 to produce ice when ice is required without lowering the temperature of beverage chamber 120 and lower chamber 122 when the temperature of the chambers (120 and 122) are below a user defined temperature set point, which is input by consumer through user interface panel 330, e.g., a temperature set point such as 34 degrees Fahrenheit.

Similarly, controller 340 may also be configured to activate sealed refrigeration system 620 and selectively open first refrigerant valve 600, selectively close second refrigerant valve 602 and selectively open third refrigerant valve such to actively flow refrigerant to chamber evaporator 626 (to facilitate cooling of air forced into beverage chamber 120 and lower chamber 122) and to prevent refrigerant from flowing to ice maker evaporator 628. In this way controller 320 can cause sealed refrigeration system 620 to force cool or chilled air into beverage chamber 120 and lower chamber 122 when the temperature of said chambers (120 and 122) is above a user defined temperature threshold, e.g., a user defined temperature set point which is input by consumer through user interface panel 330, such as 34 degrees Fahrenheit, but when the production of ice is not requested or required of ice maker assembly 400.

In an alternate embodiment valve 602 can be a check valve which prevents refrigerant from flowing from chamber evaporator 626 to ice maker evaporator 628. In this configuration third refrigerant valve 603 would not be required. Rather, first refrigerant valve 600 can be a three-way valve, and can selectively open and close to actively flow refrigerant to chamber evaporator 626 (to facilitate cooling of air forced into beverage chamber 120 and lower chamber 124) and/or to ice maker evaporator 628 (to facilitate production of ice by ice maker assembly 400).

During operation of sealed refrigeration system 620, refrigerant exits chamber evaporator 626 and ice maker evaporator 628 as a fluid in the form of a superheated vapor and/or vapor mixture. Upon exiting evaporators (626 and 628), the refrigerant enters compressor 622 wherein the pressure and temperature of the refrigerant are increased such that the refrigerant becomes a superheated vapor. The superheated vapor from compressor 622 enters condenser 624 wherein energy is transferred therefrom and condenses refrigerant into a saturated liquid and/or liquid vapor mixture. This fluid exits condenser 624. Upon exiting condenser 624, the pressure and temperature of the refrigerant drop at which time the refrigerant enters evaporators (626 and/or 628) and the cycle repeats itself. Notably, in some embodiments, sealed refrigeration system 620 may additionally include fans (such as fan 625) for facilitating heat transfer from the condenser 624. It should additionally be noted that, in exemplary embodiments, controller may be in operative communication with the sealed refrigeration system 620, such as with the compressor 622 thereof, and may activate the sealed refrigeration system 620 as desired or required for ice making purposes.

Figure 7:
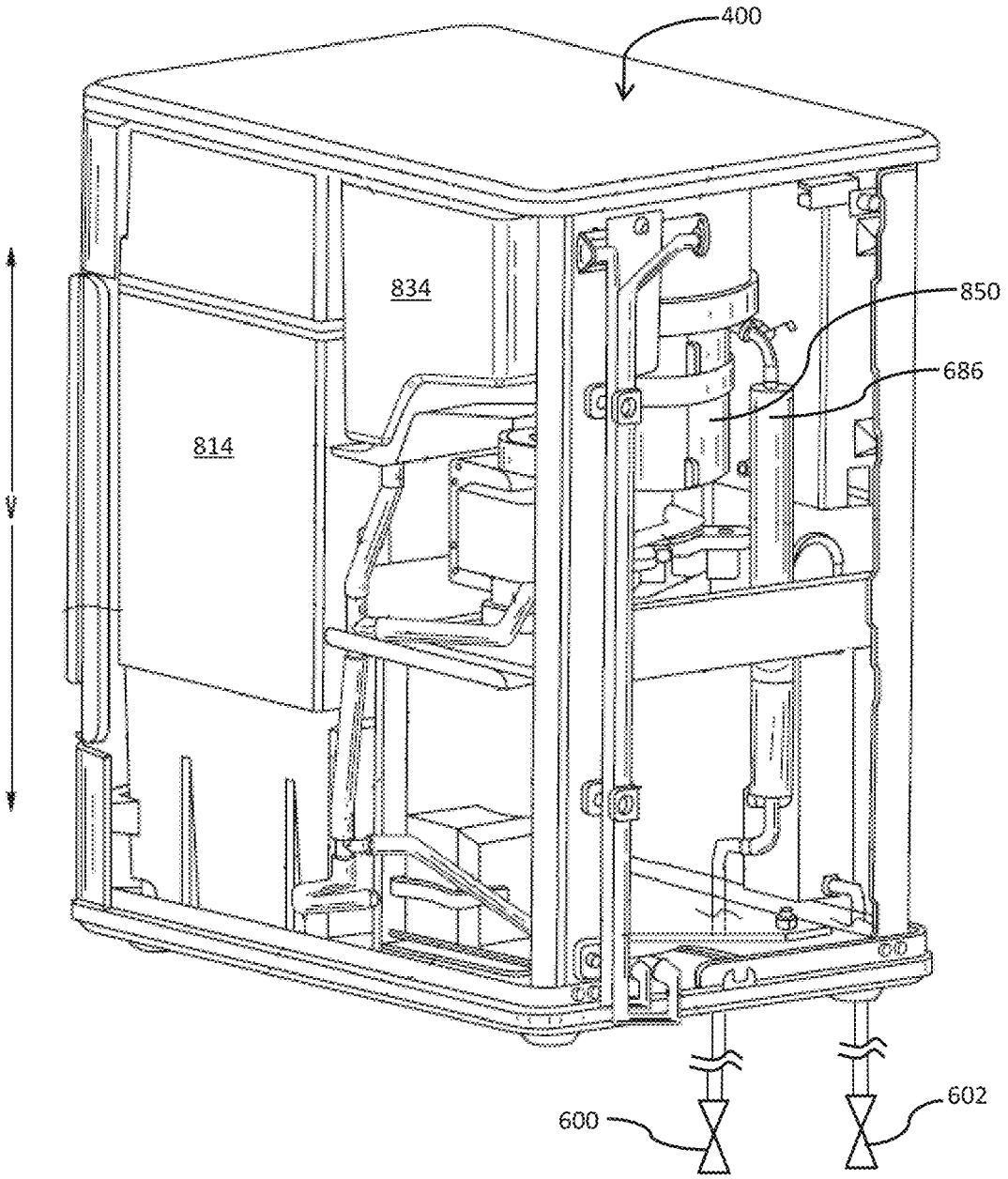
FIG. 7 provides a perspective rear view of an example of a partially assembled ice maker assembly of the stand-alone ice and beverage appliance of FIGS. 1 through 5 and 10.
Figure 8:
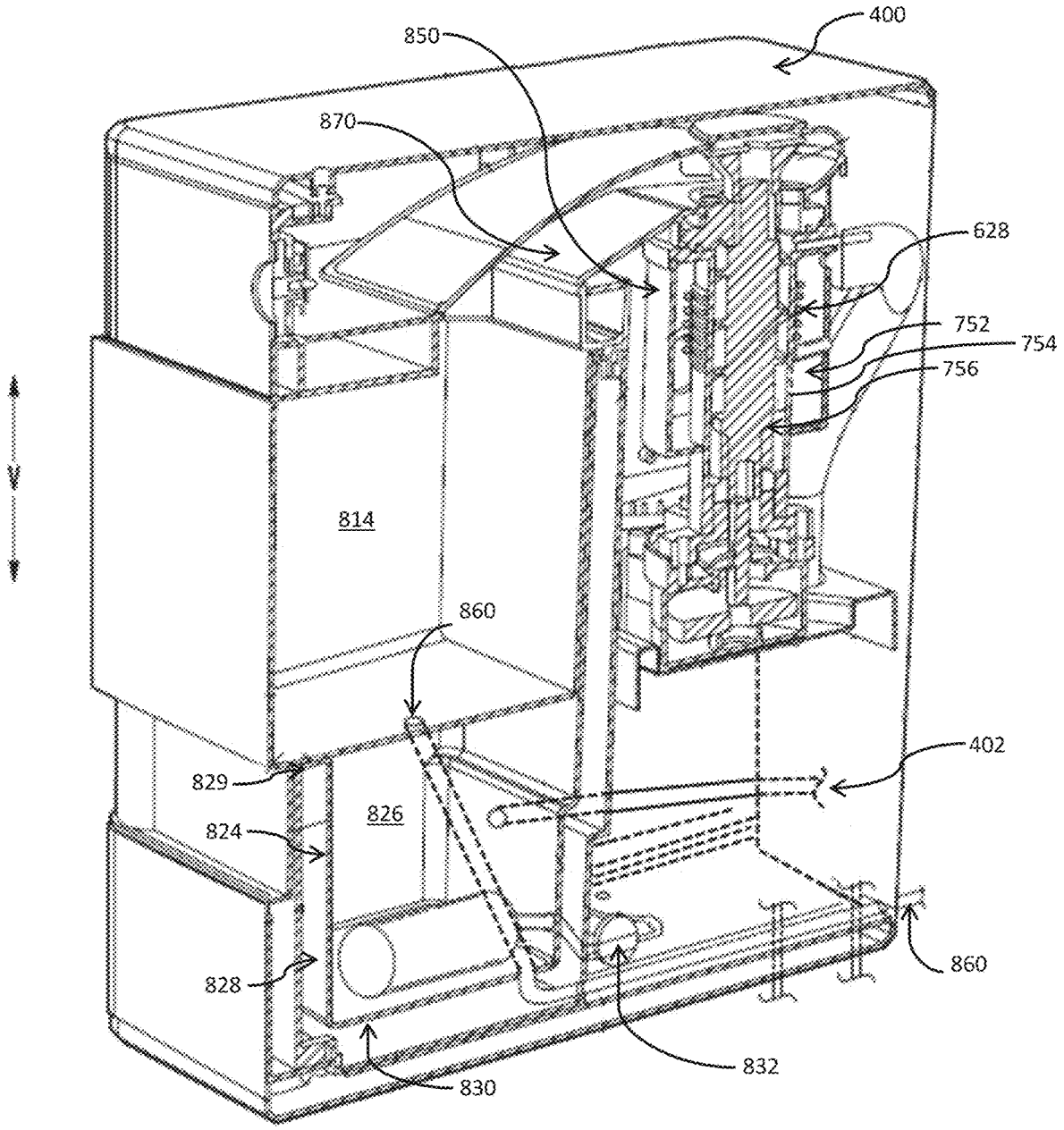
FIG. 8 provides a perspective sectional view of the ice maker assembly of FIG. 7.

Referring now generally to FIGS. 7 and 8. FIG. 7 provides a perspective rear view of a partially assembled ice maker assembly 400 of the stand-alone ice and beverage appliance of FIGS. 1, 4 and 5. FIG. 8 provides a perspective sectional view of the ice maker assembly 400 of the stand-alone ice and beverage appliance of FIGS. 1, 4 and 5.

Ice maker assembly 400 includes a water tank 824. The water tank 824 extends in the vertical direction V to define a storage volume 826 for the receipt and holding of water from supply line 402. Water tank 824 may include one or more sidewalls 828 extending between a top portion 829 and a base wall 830 which may together define the storage volume 826. In alternate embodiments supply line 402 may be attached to ice maker assembly 400 to provide water from water source 406 to interior volume 756.

In certain embodiments water can be provided to the water tank 824 for use in forming ice. Accordingly, ice maker assembly 400 may further include a pump 832. Generally, pump 832 is disposed in fluid communication with the storage volume 826. When activated, pump 832 may actively flow water from the storage volume 826 therethrough and from the pump 832.

During ice making operation, water actively flowed from the pump 832 may be selectively flowed to a reservoir 834. Reservoir 834 may receive and contain water to be provided to an ice maker 850 to produce ice. Ice maker 850 generally receives water, such as from reservoir 834 and/or pump 832. After water is received by ice maker 850, ice maker 850 generally freezes the water to form ice. In exemplary embodiments, ice maker 850 is a nugget ice maker, and in particular is an auger-style ice maker, although other suitable styles of ice makers and/or appliances are within the scope and spirit of the present disclosure. Formed ice may be provided by the ice maker 850 to ice container 814. For example, as shown, chute 870 is generally positioned above ice container 814 along the vertical direction V. Thus, ice can slide off of chute 870 and drop into ice container 814. Ice container 814 can be opened by user sliding or tilting container away from ice maker assembly 400 to allow user to scoop ice from ice container 814.

In exemplary embodiments, controller 340 may be in operative communication with the pump 832. Such operative communication may be via a wired or wireless connection, and may facilitate the transmittal and/or receipt of signals by the controller 340 and pump 832. Controller 340 may be configured to activate the pump 832 and activate transfer pump 408 to actively flow water. For example, controller may activate the pump 832 to actively flow water therethrough when, for example, reservoir 834 requires water. In turn controller may activate transfer pump 408 to provide water to water tank 824. Suitable sensor(s), for example, may be provided in the water tank 824. The sensor(s) may be in operative communication with the controller 340 may be transmit signals to the controller 340 which indicate whether or not additional water is desired in the reservoir 834 or water tank 824. When controller receives a signal that water is desired in ice maker assembly 400, controller may send a signal to pump 832 and/or transfer pump 408 to activate pump 832 and/or transfer pump 408.

As discussed, in exemplary embodiments, ice may be nugget ice. Nugget ice is ice that that is maintained or stored (i.e., in ice container 814) at a temperature greater than the melting point of water or greater than about thirty-two degrees Fahrenheit. Accordingly, the ambient temperature of the environment surrounding the ice container 814 may be at a temperature greater than the melting point of water or greater than about thirty-two degrees Fahrenheit. In some embodiments, such temperature may be greater than forty degrees Fahrenheit, greater than fifty degrees Fahrenheit, or greater than sixty degrees Fahrenheit.

Ice held within the ice container 814 may gradually melt. The melting speed is increased for nugget ice due to the increased maintenance/storage temperature. Accordingly, drain features, such as a drain 860, may advantageously be provided in the container for draining such melt water. Additionally, and advantageously, the melt water may, in some embodiments, be reused by ice maker assembly 400 to form ice by draining water, in part, to water tank 824.

In some exemplary embodiments, drain 860 may be connected to a domestic drain or alternatively a drainage receptacle 861 (shown in FIG. 4), e.g., a pan. Drain 860 may be formed as a hollow conduit of a suitable resilient material, e.g., rubber (natural or synthetic), plastic, etc. Additionally, a drain pump 862 can be provided to pump water or other liquid which passes through drain 860 to a suitable location for disposable, e.g., an existing domestic sanitary drain in a structure.

Figure 9:
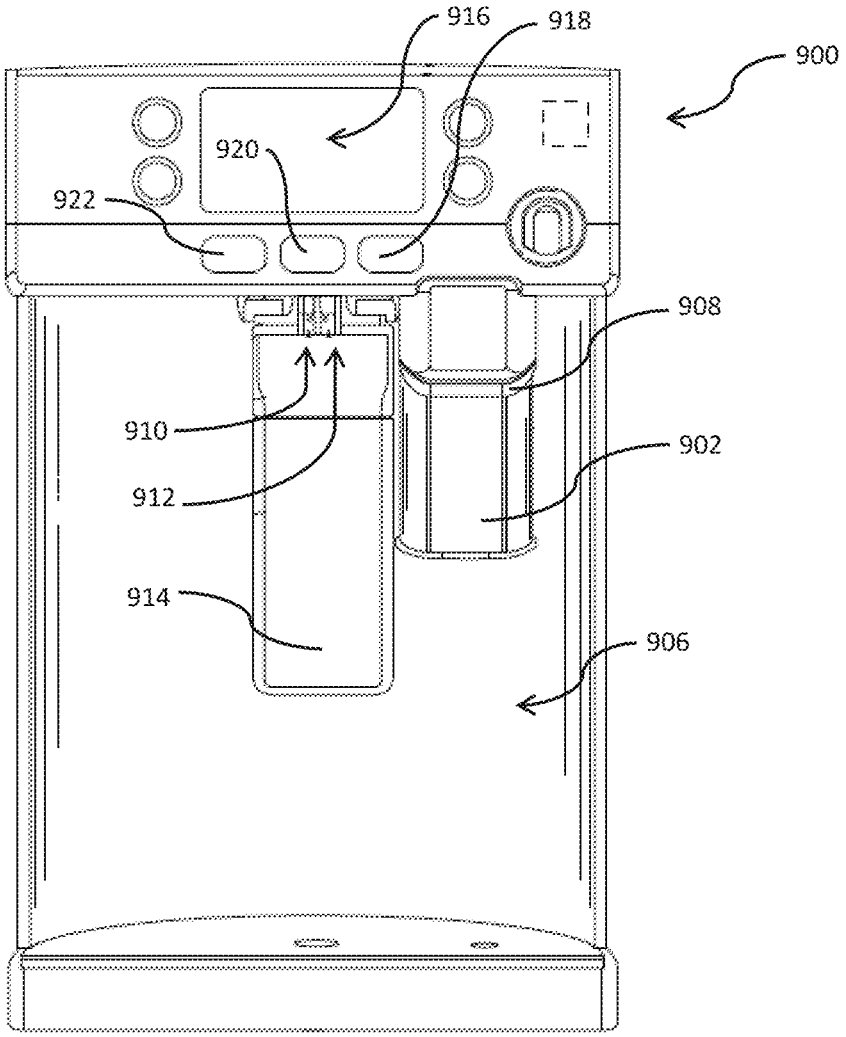
FIG. 9 provides a front, elevation view of a water dispensing assembly including a single serve beverage dispenser according to an exemplary embodiment of the stand-alone ice and beverage appliance of FIGS. 1 through 5 and 10.
Figure 10:
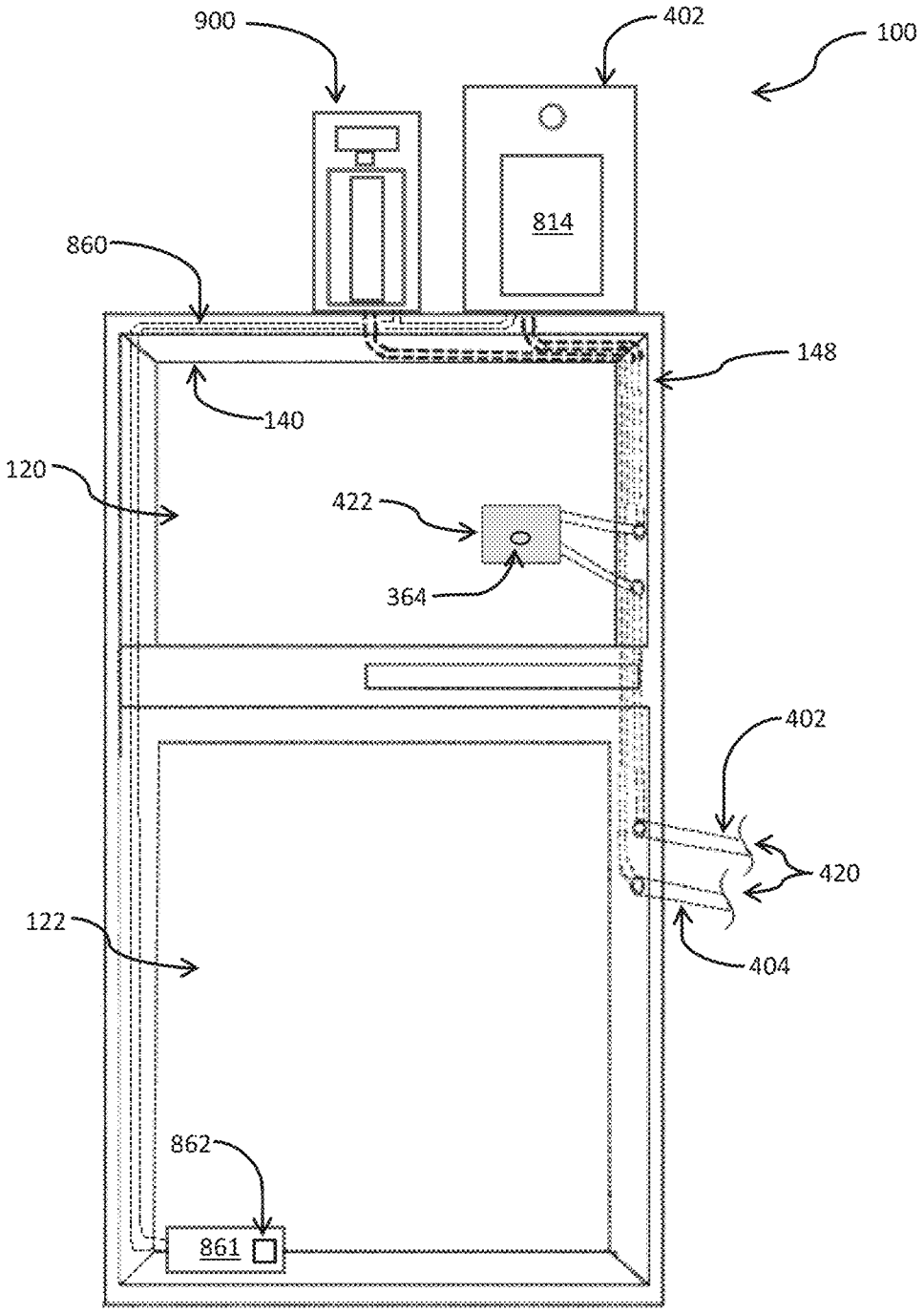
FIG. 10 depicts a front view of an example embodiment of a stand-alone ice and beverage appliance according to exemplary embodiments of the present disclosure, with chamber doors removed for clarity.

FIG. 9 provides a front, elevation view of another embodiment of a dispensing assembly including a single serve beverage dispenser or brew module 900. Brew module 900 can be utilized with stand-alone ice and beverage appliance of FIGS. 1, 4 and 5, in place of water dispensing assembly 300, as depicted in FIG. 10. Brew module 900 which can receive capsules or pods with flavorings therein that are brewed or mixed with hot or cold water to provide a hot or cold beverage. As an example, brew module 900 may be a KEURIG® brand single-cup coffee brewing system or a VERISMO™ brand single-cup coffee brewing system.

Brew module 900 may include a body 902 that defines a brew chamber (not shown) that is configured to receive a brew pod (not shown) associated with a brewed beverage (e.g., coffee or tea). A lid 908 is pivotally attached to body 902 to permit selective access to brew chamber. More specifically, lid 908 is pivotable between a closed position and an open position, as well as one or more intermediate positions therebetween. In addition, single serve beverage dispenser 902 can include one or more needles (not shown) positioned proximate to the brew chamber. The needles are each configured for piercing brew pod and may define one or more channels and/or apertures for passing liquid through needles. For example, the needles may define one or more water supply holes configured for supplying water from supply line 404 (FIGS. 4 and 5), which is heated by a heating assembly within the brew module 900, into brew pod to facilitate the brewing or beverage making process. Similarly, needles may define one or more holes through which liquid may pass out of brew pod.

Brew pod can be a container that contains (or is fillable with) a predetermined amount of brewing contents, such as coffee, tea, hot chocolate, lemonade, or the like. The brewing contents are mixed with water to create a beverage that is dispensed to the user. Brew pod may be a single-use pod or a reusable pod. During use, once brew pod is received in brew module 900 and brew module 900 is inserted into water dispensing assembly 300, moving water delivery tube provides heated water into brew pod. The heated water may mix with contents within brew pod, and a liquid brewed beverage may then flow from brew module 900 through heated liquid outlet 912 into, for example, a container or cup (not shown) typically placed within dispenser recess 906 below brew module 900.

Brew module 900 includes one or more outlets for accessing chilled liquid water, and heated liquid water or the brewed beverage. Brew module 900 can dispense various fluids, such as chilled liquid water, heated liquid water and a brewed beverage, to a dispenser recess 906 defined within brew module 900. Brew module 900 includes a chilled liquid outlet 910 positioned on an exterior portion of brew module 900, for example, within dispenser recess 906. Chilled liquid outlet 910 includes an opening for chilled liquid water or another chilled beverage to be dispensed. Brew module 900 includes a heated liquid outlet 912 positioned on an exterior portion of brew module 900, for example, within dispenser recess 906. Heated liquid outlet 912 includes an opening for heated liquid water, a brewed beverage or another heated beverage to be dispensed.

To access liquid water or another beverage, brew module 900 may, for example, include a paddle 914 mounted below a liquid outlets (910 and 912). To initiate certain exemplary operations of brew module 900, a user can utilize brew module interface 916 to select the type of liquid which the user desires brew module 900 to dispense and thereafter, place or press a container (not shown), such as a cup or bowl, against paddle 914 to initiate a flow of liquid, e.g. water, into the container within dispenser recess 906.

In some embodiments, a brew module interface 916 may be provided for controlling the mode of operation of brew module 900, and the components thereof, (e.g., for enabling the operation of or turning on the brew module 900). Brew module interface 916 can include a chilled water dispensing button 918, a heated water dispensing button 920, a brewed beverage dispensing button 922 and other buttons (not labeled), e.g., temperature control buttons for setting or adjusting the temperature of the heated or cooled liquid. Additionally or alternatively, brew module interface 916 can include one or more inputs (e.g., buttons, switches, touch screen panels, etc.) for selecting various operations, such a preset dispensing operation (e.g., for a heated fluid or liquid). Brew module interface 916 may also include a display component, such as a digital or analog display device designed to provide operational feedback to the user.

In certain embodiments, brew module 900 included with ice and beverage appliance 100, also includes features for generating heated liquid water. Ice and beverage appliance 100 need not be connected to a residential hot water heating system in order to supply heated liquid water to brew module 900. Rather, it will be appreciated that brew module 900 can include features such an electric water heating element hot water tank, temperature sensors, and control valves to heat water from a well or municipal water supply, store the heated water, and supply the heated water to brew module. Alternatively, brew module 900 may include a heating element, which may for example be disposed in fluid heating assembly, for heating the fluid before the fluid is flowed from the heated liquid outlet 912.

FIG. 10 depicts a front view of an example embodiment of a stand-alone ice and beverage appliance 100 according to exemplary embodiments of the present disclosure, with chamber doors (124 and 126) removed for clarity. In this example embodiment, chamber doors (124 and 126) can be mechanically attached or fixed to housing 110 (e.g., with screw, bolts or other fasteners) such that chamber doors (124 and 126) are not user accessible but can be removed by a technician for repair or maintenance.

As shown in FIG. 10, ice and beverage appliance 100 can include one or more supply lines conduits or hoses (402 and 404) in fluid connection with a domestic water supply or city water supply (not shown) at connection point 420. Supply line 402 can be in fluid connection between connection point 420 and ice maker assembly 400 to enable the transfer of water from domestic water supply or city water supply (not shown) to ice maker assembly 400 to facilitate production of ice. Similarly, supply line 404 can be in fluid connection between domestic water supply or city water supply (not shown) and brew module 900 to enable the transfer of water from a domestic water supply or city water supply (not shown) to brew module 900 to facilitate providing liquid water to a user through chilled liquid outlet 910 and heated liquid outlet 912 (shown in FIG. 9).

Ice and beverage appliance 100 can include a chilling assembly 422 disposed within beverage chamber 120. Chilling assembly 422 can be a reservoir configured to retain a volume of liquid water from supply line 404. Said liquid water is chilled by chilling assembly 422 within beverage chamber 120 prior to said liquid water being dispensed to a user through chilled liquid outlet 910. In this exemplary embodiment, beverage chamber 120 may or may not be chilled by sealed system 620. Alternatively, chilling assembly 422 can be in thermal communication with sealed system 620, to facilitate chilling or liquid water within chilling assembly. One of ordinary skill in the art would appreciate that in certain embodiments, chilling assembly 422 could be any known water-cooling heat exchanger. In some embodiments, chilling assembly 422 can include a reservoir (not shown) configured to retain a volume of liquid water from supply line 404 and also include a coil of tubing (not shown), which is at least partially contained within reservoir and said tubing is in thermal communication with sealed system 620 (e.g., such as being in thermal communication with chamber evaporator 626 or refrigerant conduit 605 shown in FIG. 6) to facilitate the chilling liquid water within the reservoir prior to said liquid water being dispensed to a user through chilled liquid outlet 910. Chilling assembly 422 can also include one or more temperature sensors 364 for determining the temperature of the liquid water within chilling assembly 422. Controller 340 can also receive signals from other inputs associated with ice and beverage appliance 100 including ambient temperature, ambient humidity, or the like. Moreover, controller 340 is operatively coupled to the sealed system 620 (shown in FIG. 5), whereby, certain functions are performed in response to signals received from these inputs.

In the exemplary embodiment, controller 340 operates sealed system 620 based on one or more characteristics of one or more temperature sensor 364 in chilling assembly 422. Temperature sensor 364 can be any known electronic temperature sensing devices, such as the one or more thermistors. Specifically, controller 340 can receive data indicative of the one or more characteristics of the temperature sensor 364 and process the data to determine the temperature of the chilling assembly 422 and/or the liquid water contained therein. Controller 340 can compare the temperature of the chilling assembly 422 and/or the liquid water contained therein to one or more predetermined temperature thresholds, which can be provided by a user through user interface 330, and operate sealed system 620 based on whether the temperature of the chilling assembly 422 and/or the liquid water contained therein is above or below the one or more predetermined temperature thresholds.

Although specific features of various embodiments may be shown in some drawings and not in others, this is for convenience only. In accordance with the principles of the present disclosure, any feature of a drawing can be referenced and/or claimed in combination with any feature of any other drawing.

This written description uses examples for the disclosure, including the best mode, and also to enable any person skilled in the art to practice the disclosure, including making and using any devices or systems and performing any incorporated methods. The patentable scope of the disclosure is defined by the claims, and can include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An ice and beverage dispenser appliance, the appliance comprising:

a cabinet defining a chilled chamber, an insulated compartment, a bottom portion and a countertop, wherein the chilled chamber defines a beverage chamber and a lower chamber situated below the beverage chamber, and wherein the insulated compartment is adjacent to both the lower chamber and the bottom portion of the cabinet;

an ice maker assembly mounted on the countertop;

a liquid dispenser assembly mounted on the countertop;

a reservoir disposed within the beverage chamber;

a water pick-up line;

a water source comprising a water bottle contained within the lower chamber, wherein the water pick-up line is partially submerged within the water bottle and configured to provide water to both the ice maker assembly and the liquid dispenser assembly; and a sealed refrigeration system, comprising:

a compressor and a condenser enclosed in the insulated compartment, a chamber evaporator in thermal communication with the lower chamber and the beverage chamber, and an ice maker assembly evaporator fluidly coupled through a refrigerant conduit, wherein the compressor is operably coupled to the refrigerant conduit for circulating a flow of refrigerant through the refrigerant conduit;

a plurality of valves; and a controller configured to control the plurality of valves such that the plurality of valves selectively provide the flow of refrigerant to the chamber evaporator to refrigerate the chilled chamber and selectively provide the flow of refrigerant to the ice maker assembly evaporator for ice production, wherein selectively providing a flow of refrigerant to the ice maker assembly evaporator is based, at least in part, on a comparison, performed by the controller, of a temperature of the chilled chamber and a temperature threshold.

2. The ice and beverage appliance of claim 1, wherein the water bottle comprises a portable water bottle contained within the lower chamber.

3. The ice and beverage appliance of claim 2, further comprising:

a transfer pump configured to transfer water from the water bottle to the ice maker assembly and the liquid dispenser assembly.

4. The ice and beverage appliance of claim 3, wherein the ice maker assembly comprises a nugget ice maker.

5. The ice and beverage appliance of claim 4, wherein the plurality of valves comprise:

a check valve which prevents refrigerant from flowing from the chamber evaporator to the ice maker evaporator; and a three-way valve operably coupled to the refrigerant conduit between the ice maker evaporator and the chamber evaporator and configured to selectively open to allow the flow of refrigerant to circulate through the ice maker evaporator and the chamber evaporator.

6. The ice and beverage appliance of claim 5, wherein the controller is further configured to control the ice maker assembly, the liquid dispenser assembly, the sealed system, the check valve and the three-way valve.

* * * * *